US007841396B2

(12) United States Patent
Surjaatmadja

(10) Patent No.: US 7,841,396 B2
(45) Date of Patent: Nov. 30, 2010

(54) HYDRAJET TOOL FOR ULTRA HIGH EROSIVE ENVIRONMENT

(75) Inventor: Jim B. Surjaatmadja, Duncan, OK (US)

(73) Assignee: Halliburton Energy Services Inc., Duncan, OK (US)

( * ) Notice: Subject to any disclaimer, the term of this patent is extended or adjusted under 35 U.S.C. 154(b) by 128 days.

(21) Appl. No.: 11/748,087

(22) Filed: May 14, 2007

(65) Prior Publication Data

US 2008/0283299 A1 Nov. 20, 2008

(51) Int. Cl.
*E21B 43/00* (2006.01)

(52) U.S. Cl. ..... 166/177.5; 166/242.4

(58) Field of Classification Search ..... 166/177.5, 166/242.4

See application file for complete search history.

(56) References Cited

U.S. PATENT DOCUMENTS

| | | | | |
|---|---|---|---|---|
| 3,145,776 | A | 8/1964 | Pittman | 166/55 |
| 4,050,529 | A | 9/1977 | Tagirov et al. | 175/422 |
| 4,103,748 | A * | 8/1978 | Arnold | 175/61 |
| 4,243,727 | A * | 1/1981 | Wisler et al. | 428/558 |
| 5,181,569 | A * | 1/1993 | McCoy et al. | 166/317 |
| 5,765,642 | A | 6/1998 | Surjaatmadja | |
| 6,286,599 | B1 | 9/2001 | Surjaatmadja et al. | |
| 7,017,665 | B2 | 3/2006 | Nguyen | |
| 7,059,406 | B2 | 6/2006 | Nguyen | |
| 7,104,320 | B2 | 9/2006 | Buchanan et al. | |
| 7,159,660 | B2 | 1/2007 | Justus | |
| 7,225,869 | B2 | 6/2007 | Willett et al. | |
| 7,445,045 | B2 | 11/2008 | East, Jr. et al. | |
| 7,571,766 | B2 | 8/2009 | Pauls et al. | |
| 7,617,871 | B2 | 11/2009 | Surjaatmadja et al. | |
| 2005/0284643 | A1 * | 12/2005 | Setterberg, Jr. | 166/378 |
| 2006/0000610 | A1 | 1/2006 | Farabee et al. | |
| 2006/0022073 | A1 * | 2/2006 | King et al. | 239/590 |
| 2006/0283592 | A1 | 12/2006 | Sierra et al. | |
| 2008/0110622 | A1 | 5/2008 | Willett et al. | |
| 2009/0242202 | A1 | 10/2009 | Rispler et al. | |

FOREIGN PATENT DOCUMENTS

| | | |
|---|---|---|
| WO | WO 97/14868 | 4/1997 |
| WO | WO2009063162 A2 | 5/2009 |

OTHER PUBLICATIONS

International Search Report for International Application No. PCT/GB2008/001527, Sep. 4, 2008.
International Preliminary Report on Patentability for PCT/GB2008/001527, Nov. 17, 2009.
Foreign Office Action for Application No. 08 750 500.4-2315 (Examination), dated Mar. 25, 2010.

* cited by examiner

*Primary Examiner*—David J Bagnell
*Assistant Examiner*—David Andrews
(74) *Attorney, Agent, or Firm*—John W. Wustenberg; Baker Botts L.L.P.

(57) ABSTRACT

The present invention relates to an improved method and system for perforating, slotting, and cutting steel and subterranean rock; and also for fracturing a subterranean formation to stimulate the production of desired fluids therefrom. The invention involves a fluid jetting device with a sleeve composed of a hard material. The sleeve includes at least one hole and a fluid flowing through the jetting device is emitted through the hole in the sleeve.

19 Claims, 5 Drawing Sheets

HYDRAJET TOOL FOR ULTRA HIGH EROSIVE ENVIRONMENT

BACKGROUND OF THE INVENTION

The present invention primarily relates to mining and subterranean well formations. More particularly, the present invention relates to an improved method and system for perforating, slotting, and cutting steel and subterranean rock; and also for fracturing a subterranean formation to stimulate the production of desired fluids therefrom.

Jetting tools are used in a number of different industries and have a variety of different applications. For instance, jetting tools are used in subterranean operations such as perforating and hydraulic fracturing.

Hydraulic fracturing is often utilized to stimulate the production of hydrocarbons from subterranean formations penetrated by well bores. Typically, in performing hydraulic fracturing treatments, the well casing, where present, such as in vertical sections of wells adjacent the formation to be treated, is perforated. This perforating operation can be performed using explosive means or hydrajetting. Where only one portion of a formation is to be fractured as a separate stage, it is then isolated from the other perforated portions of the formation using conventional packers or the like, and a fracturing fluid is pumped into the well bore through the perforations in the well casing and into the isolated portion of the formation to be stimulated at a rate and pressure such that fractures are formed and extended in the formation. A propping agent may be suspended in the fracturing fluid which is deposited in the fractures. The propping agent functions to prevent the fractures from closing, thereby providing conductive channels in the formation through which produced fluids can readily flow to the well bore. In certain formations, this process is repeated in order to thoroughly populate multiple formation zones or the entire formation with fractures.

One method for fracturing formations may be found in U.S. Pat. No. 5,765,642, incorporated herein by reference in its entirety, whereby a hydrajetting tool is utilized to jet fluid through a nozzle against a subterranean formation at a pressure sufficient to form a cavity and fracture the formation using stagnation pressure in the cavity.

Hydrajetting in oil field applications often involves long duration jetting for cutting a multitude of casing strings and perforations. This problem is greatly magnified when a hydrajetting tool is utilized to form a cavity and fracture the formation using the stagnation pressure in the cavity as discussed in U.S. Pat. No. 5,765,642. This is because millions of pounds of proppants may be flowing through the hydrajetting tool at very high velocities in order to form a cavity and fracture the formation. One solution for withstanding the abrasive forces encountered during the jetting process is to make the jetting tool from an ultra-hard material. However, the jetting tool cannot be made of a very hard material to avoid erosion because such materials are brittle and will shatter during jetting operations or when the jetting tool is moved in and out of the jetting location. Consequently, the current jetting tools comprise a cylindrical structure which cannot withstand the abrasive forces. In some applications a fluid jet that is made of a hard material is installed on the cylindrical structure. Hence, one disadvantage of the current hydrajetting methods is that the jetting tool is eroded during operation. In order to deal with this erosion the jetting tool must be extracted from the hole to be repaired or replaced. The extraction of the jetting tool can be expensive and could also lead to a job failure. In such situations it would be desirable to have a method and tool for delivering fluids to the formation to be fractured which could withstand the impact of the erosive forces.

SUMMARY

The present invention primarily relates to mining and subterranean well formation. More particularly, the present invention relates to an improved method and system for perforating, slotting, and cutting steel and subterranean rock; and also for fracturing a subterranean formation to stimulate the production of desired fluids therefrom.

In one embodiment, the present invention is directed to an abrasive resistance jetting tool which includes a sleeve. The sleeve is composed of a material with a hardness greater than 75 Rockwell A and has at least one hole in its wall. A fluid flowing through the sleeve can exit through the hole.

In another embodiment the present invention is directed to a fluid jetting device with a cylindrical body having a hardness greater than 75 Rockwell A. A fluid flowing through the cylindrical body is emitted through an orifice in the cylindrical body.

In certain embodiments the present invention may include a holder enclosing the jetting device. The holder includes holes that align with the holes in the sleeve in order to allow the emission of a fluid from the sleeve.

The features and advantages of the present invention will be apparent to those skilled in the art from the description of the preferred embodiments which follows when taken in conjunction with the accompanying drawings. While numerous changes may be made by those skilled in the art, such changes are within the spirit of the invention.

BRIEF DESCRIPTION OF THE DRAWINGS

These drawings illustrate certain aspects of some of the embodiments of the present invention, and should not be used to limit or define the invention.

DETAILED DESCRIPTION

The present invention primarily relates to mining and subterranean well formation. More particularly, the present invention relates to an improved method and system for perforating, slotting, and cutting steel and subterranean rock; and also for fracturing a subterranean formation to stimulate the production of desired fluids therefrom.

In wells penetrating certain formations, and particularly deviated wells, it is often desirable to create a number of structures, including perforations, small fractures, large fractures, or a combination thereof. Oftentimes, these structures are created by operations that are performed using a hydrajet tool.

One of the most severe jetting applications is encountered when using the hydrajet tool as a fracturing tool as discussed in U.S. Pat. No. 5,765,642. During the fracturing process the fracturing tool is positioned within a formation to be fractured and fluid is then jetted through the fluid jet against the formation at a pressure sufficient to cut through the casing and cement sheath and form a cavity therein. The pressure must be high enough to also be able to fracture the formation by stagnation pressure in the cavity. A high stagnation pressure is produced at the tip of a cavity in a formation being fractured because of the jetted fluids being trapped in the cavity as a result of having to flow out of the cavity in a direction generally opposite to the direction of the incoming jetted fluid. The high pressure exerted on the formation at the tip of the cavity causes a fracture to be formed and extend some distance into the formation. In certain situations, a propping agent is suspended in the fracturing fluid which is deposited in the fracture. The propping agent may be a granular substance such as, for example, sand grains, ceramic or bauxite or other man-made grains, walnut shells, or other material carried in suspension by the fracturing fluid. The propping agent functions to prevent the fractures from closing and thereby provides conductive channels in the formation through which produced fluids can readily flow to the well bore. The presence of the propping agent also increases the erosive effect of the jetting fluid.

In order to extend the fracture formed as described above further into the formation in accordance with this invention, a fracturing fluid is pumped through the fracturing tool and into the well bore to raise the ambient fluid pressure exerted on the formation. The fluid is pumped into the fracture at a rate and high pressure sufficient to extend the fracture an additional distance from the well bore into the formation.

Figure 1:
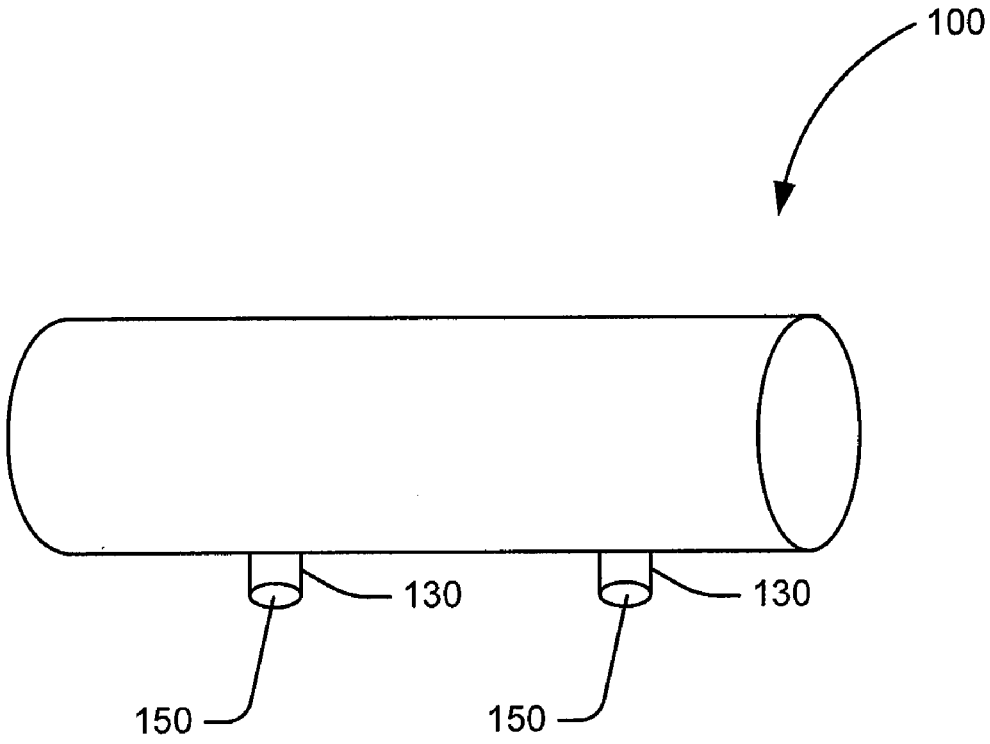
FIG. 1 (PRIOR ART)
FIG. 1 illustrates a hydrajetting tool in accordance with the prior art.

The details of the present invention will now be discussed with reference to the figures. Turning to FIG. 1, a hydrajetting tool in accordance with the prior art is shown generally by reference numeral 100. Nozzle 130 may extend beyond the surface of the outer wall as depicted in FIG. 1, or nozzle 130 may extend only to the surface of the outer wall of the hydrajetting tool 100. The orientation of nozzle 130 may be modified depending upon the formation to be fractured. The nozzle 130 has an exterior opening which acts as a nozzle opening 150 that allows the passage of fluids from the inner side of hydrajetting tool 100 through the nozzle 130. Typically, the nozzle 130 may be composed of any material that is capable of withstanding the stresses associated with fluid fracture, the abrasive nature of the fracturing or other treatment fluids and any proppants or other fracturing agents used. The materials that can be used for construction of the nozzle 130 may include, but are not limited to tungsten carbide, diamond composites, and certain ceramics.

Although the nozzle 130 is often composed of abrasion resistive materials such as tungsten carbide, or other certain ceramics, such materials are expensive and brittle. As a result, a tool wholly made of such substances will likely shatter as it cannot withstand the forces encountered as it moves down to the site to be fractured. Consequently, the body of the hydrajetting tool 100 is typically made of steel or similar materials that although not brittle, are not strong enough to withstand the abrasive forces encountered during the hydrajetting process.

Figure 2:
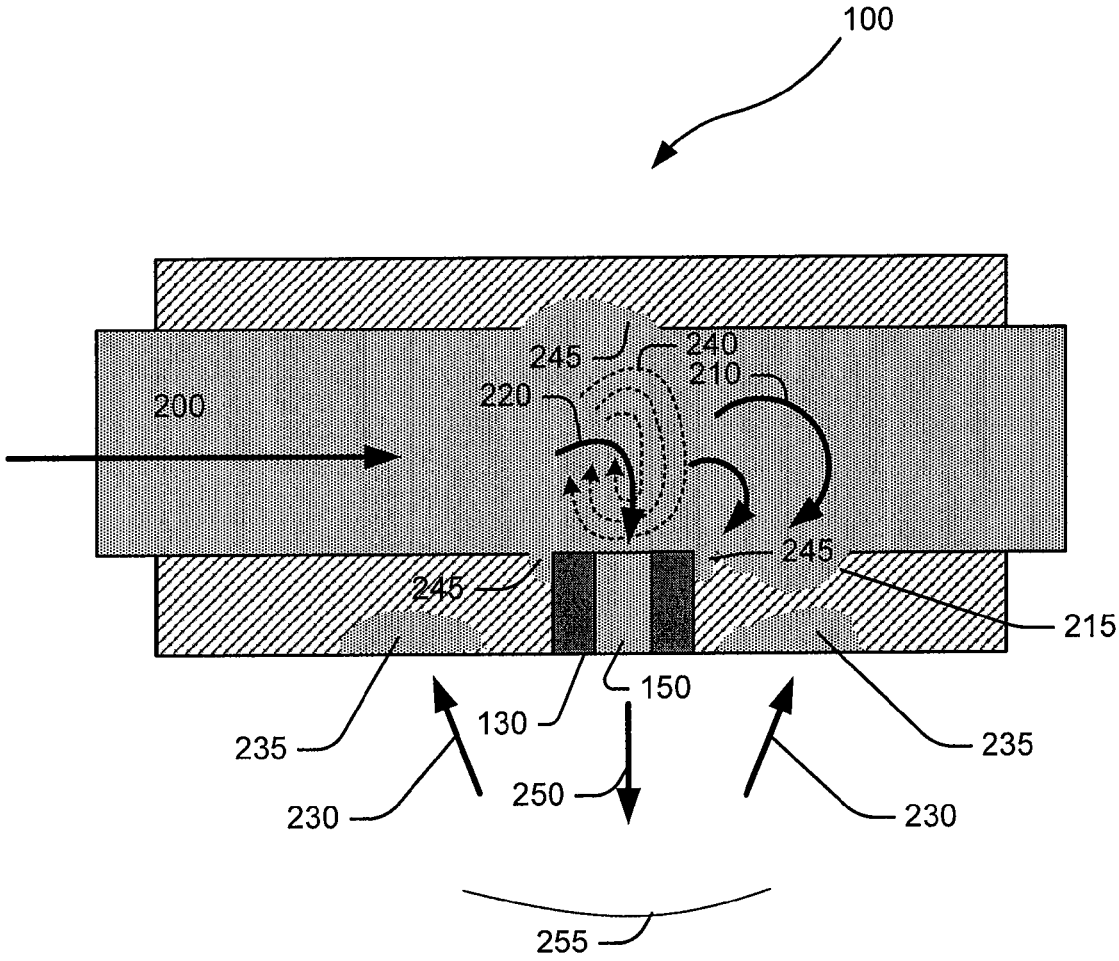
FIG. 2 PRIOR ART
FIG. 2 illustrates the impact of damage causing factors on a hydrajetting tool in accordance with the prior art.

Shown in FIG. 2, is the impact of damage causing factors on a hydrajetting tool in accordance with the prior art. Arrows are used to show the direction of the fluid flow as the fluid 200 enters the hydrajetting tool and approaches and exits the nozzle 130 through the nozzle opening 150. Typically, there are three distinct phenomena that damage the hydrajetting tool 100 as the fluid exits the nozzle 130.

First, as the fluid approaches the nozzle opening 150 it tends to rapidly turn the corner in order to exit the nozzle 130 through the nozzle opening 150. As the fluid 220 turns to exit the nozzle opening 150, some of the fluid overshoots as depicted by arrows 210. This fluid overshot also causes erosion 215 on the inner wall of the hydrajetting tool 100.

Secondly, a slight movement of the hydrajetting tool 100 can initiate a Coriolis swirling effect. The hydrajetting tool 100 is not completely stationary during the jetting process. For example, the tool may move due to vibrations resulting from the jetting process. If the hydrajetting tool 100 turns during the jetting process it will cause the fluid to start swirling, thereby creating a tornado effect 240. As the fluid swirls 240 it further erodes the inner walls 245 of the hydrajetting tool 100 along its circumference.

Figure 3:
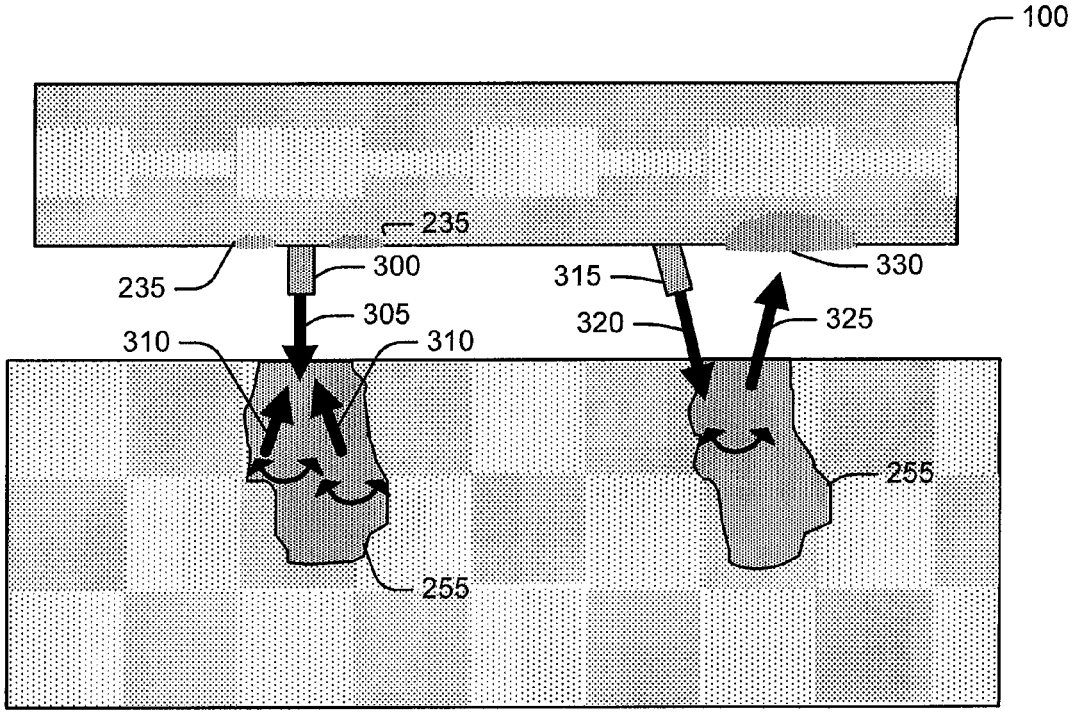
FIG. 3 PRIOR ART
FIG. 3 illustrates the result of straight jetting and angled jetting using a hydrajetting tool in accordance with the prior art.

The third major source of damage to the hydrajetting tool 100 results from the reflection of the emitted fluid 250 from the perforations 255. As the fluid reflects 230 from the perforation it erodes 235 the hydrajetting tool 100. As discussed above, in some hydrajetting tools the direction of the nozzle opening 150 may be altered depending on the formation to be fractured. The damage resulting from the reflection of the fluid is shown in more detail in FIG. 3. Depicted in FIG. 3 is a diagram showing the damage to the hydrajetting tool 100 due to reflected fluids from the perforations 255 with the nozzle 300, 315 at different angles. The reflection of the fluid onto the hydrajetting tool 100 is the least when the nozzle 300 shoots the fluid 305 straight into the perforation 255. However, at this angle the splashback fluid 310 which is moving in a direction opposite to that of the jet 305 reduces the effectiveness of the jet 305 leading to an ineffective cutting of the perforation 255. Jet 300 also reduces the effectiveness of the splashback fluid 310 in damaging the tool near the fluid exit of the jet. Massive erosion on the tool 235 still occur around the perimeter of the nozzle. On the other hand, applying the jet 320 at an angle makes the cutting process highly effective. However, due to angling the nozzle 315 the effect of fluid 325 reflected onto the hydrajetting tool 100 increases as the splashback fluid 325 is undeterred. Because the fluid 325 is shooting back at the hydrajetting tool 100 at full velocity, it will cut 330 the hydrajetting tool in a short amount of time.

Figure 4:
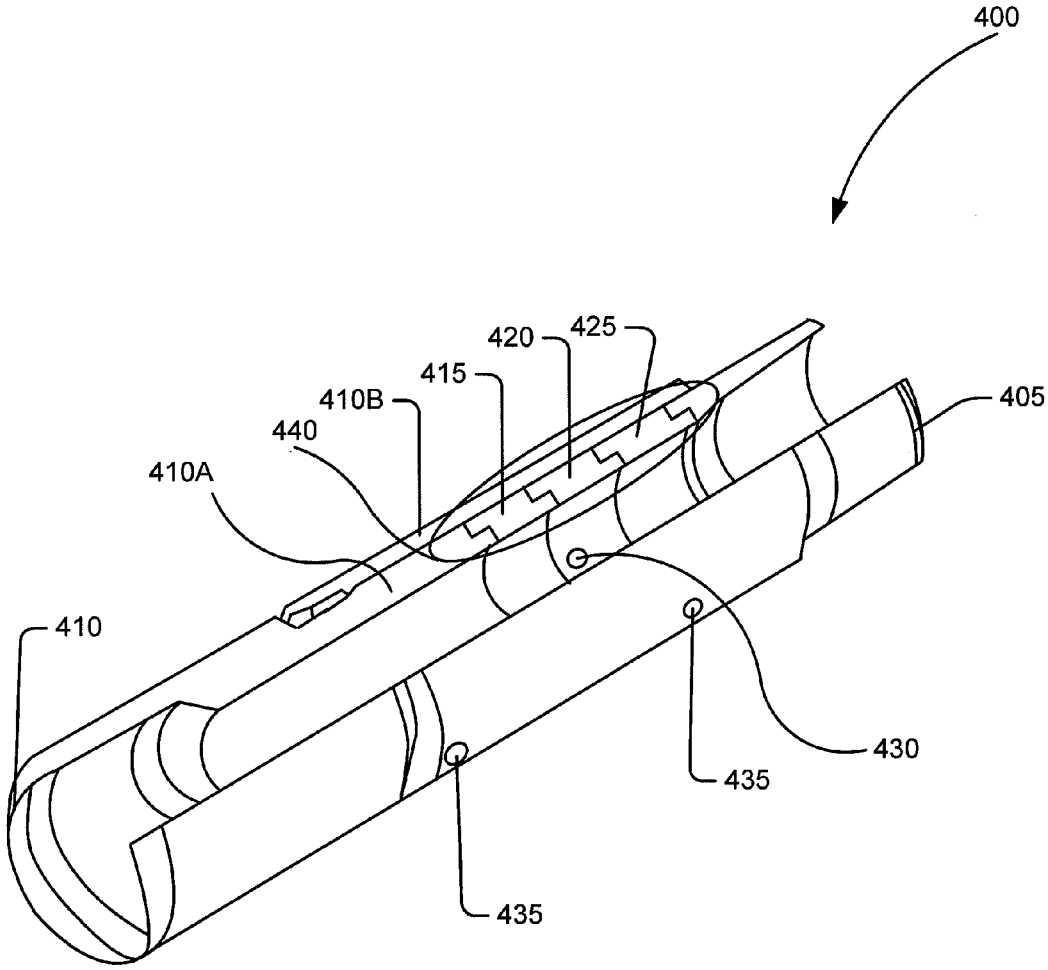
FIG. 4 illustrates a cutaway view of an improved jetting tool in accordance with an embodiment of the present invention depicting the solid sleeve, holders and associated parts.

Shown in FIG. 4 is a cutaway view of an improved jetting tool in accordance with an embodiment of the present invention shown generally with reference numeral 400. The improved jetting tool 400 includes a solid sleeve 440 comprising a plurality of hard material parts 415, 420 and 425. The hard material parts are made from a material having a hardness greater than 75 Rockwell A. The materials that may be used to make the hard material parts 415, 420, 425 include, but are not limited to, carbide or other ceramics with a high resistance to abrasive forces. The carbide used to make the hard material parts 415, 420 and 425 may be of all grades and may be a carbide with different types of binders or without binders. In an embodiment where a carbide with binders is used to make the hard material parts 415, 420 and 425, the binder may be made of a variety of suitable materials including, but not limited to, Molybdenum and Cobalt. Although the exemplary solid sleeve comprises three hard material parts 415, 420, 425, it would be readily apparent to one skilled in the art with the benefit of this disclosure that a different number of hard material parts can be used depending on the desired length of the jetting tool 400 and other factors such as the nature of the formation being fractured.

As discussed above, the suitable hard materials such as carbide or other ceramics are brittle and easily shatter. This problem is resolved by enclosing the solid sleeve 440 between a first holder 405 on one side and a second holder 410 on the other side. The second holder 410 may include a first part 410A and a second part 410B. The holders 405, 410 act as a carrier and sacrificial body on the outside of the solid sleeve 440. The primary purpose of the holders 405, 410 is to protect the solid sleeve 440 against shattering during the jetting process and as the tool is moved to and returned from a desired location. The holders may be made of a variety of materials including but not limited to steel, fiberglass, or other suitable materials.

In the exemplary embodiment, one of the hard material parts 420 includes a hole 430. There are also holes 435 created on the body of the holders 405, 410 which are aligned to match the holes of the solid sleeve 440. The number of the holes and the angles at which the holes are located can be varied depending on the nature of the formation and other relevant factors in order to achieve a desirable performance. Because holes are created directly in the body of the jetting tool 400, a nozzle need not be used and the fluid can flow out of the jetting tool 400 through the holes in the walls.

Figure 5:
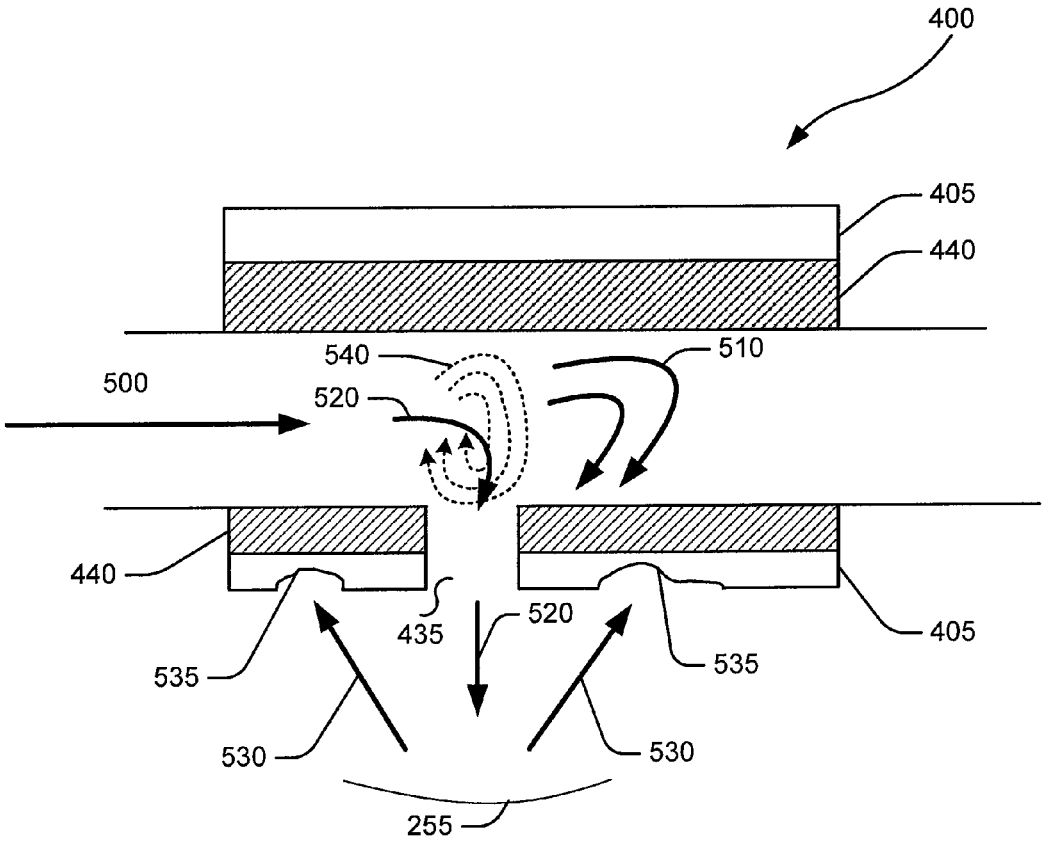
FIG. 5 illustrates the impact of damage causing factors on an improved jetting tool in accordance with an embodiment of the present invention.

Shown in FIG. 5 is the impact of damage causing factors on an improved jetting tool 400 in accordance with an embodiment of the present invention. The fluid 500 flows through the improved jetting tool 400 and exits through the hole 435 in the wall of the jetting tool 400. The causes of damage are the same as that discussed with regard to the Prior Art, namely, the fluid rapidly turning the corner 520, the fluid overshot 510, the Coriolis swirling of the fluid 540 and the reflection of the fluid 530 from the perforations 255.

However, because the solid sleeve 440 is composed of hard materials, it will not be eroded by the fluid turning the corner 520, the Coriolis swirling 540, or the overshot fluid 510. Moreover, although the reflection of the fluid 530 from the perforations 255 impacts the holder 405 and erodes 535 it, this erosion will not impact the performance of the jetting tool 400. Specifically, although the reflected fluid 530 may completely erode the holder 405, it cannot erode the hard material below it, and hence, cannot impact the operation of the jetting mechanism which is composed of the hard material forming the solid sleeve 440. The main purpose of the holder 405 is to prevent the shattering of the solid sleeve 440 and the holder 405 can perform that function despite having parts of its surface eroded 535 by the reflected fluid 530. As a result, the improved jetting tool 400 can withstand a long duration of jetting and need not be removed from the hole for part replacement until the job is completed. Moreover, any damage to holders 405, 410 can easily be repaired by simply replacing them as they are made from cheap material and are easily separable from the solid sleeve 440.

Although the present invention is described above in the context of hydrajetting and fracturing in a subterranean formation, as would be appreciated by those of ordinary skill in the art with the benefit of this disclosure, the improved jetting tool may be used in many other applications and industries.

Therefore, the present invention is well-adapted to carry out the objects and attain the ends and advantages mentioned as well as those which are inherent therein. While the invention has been depicted and described by reference to exemplary embodiments of the invention, such a reference does not imply a limitation on the invention, and no such limitation is to be inferred. The invention is capable of considerable modification, alternation, and equivalents in form and function, as will occur to those ordinarily skilled in the pertinent arts and having the benefit of this disclosure. The depicted and described embodiments of the invention are exemplary only, and are not exhaustive of the scope of the invention. Consequently, the invention is intended to be limited only by the spirit and scope of the appended claims, giving full cognizance to equivalents in all respects. The terms in the claims have their plain, ordinary meaning unless otherwise explicitly and clearly defined by the patentee.

What is claimed is:

1. A jetting tool comprising:

a sleeve for bearing and delivering a high-pressure fluid comprising a plurality of substantially cylindrical sleeve parts that interface at least longitudinally to form a sleeve wall, wherein at least one of the sleeve parts has a first hole extending radially therethrough;

a first holder that is substantially cylindrical and that longitudinally interfaces a first sleeve part of the plurality of sleeve parts;

a second holder that is substantially cylindrical and that comprises a first part that longitudinally interfaces a second sleeve part of the plurality of sleeve parts and a second part having a hole extending radially therethrough;

wherein the first hole of the at least one sleeve part and the hole of the second holder are substantially aligned;

wherein the sleeve comprises a material with a hardness greater than 75 Rockwell A;

wherein a fluid flowing in the sleeve exits through the first hole and the hole of the second holder; and wherein each of the first holder, the second holder, and the sleeve comprise an inner substantially cylindrical surface that is radially disposed about a common axis and that is configured to directly bear high-pressure fluid.

2. The jetting tool of claim 1, wherein the second part of the second holder comprises a second inner substantially cylindrical surface configured to extend around an outermost radial surface of the sleeve wall so that the second inner substantially cylindrical surface does not directly bear high-pressure fluid.

3. The jetting tool of claim 1, wherein the material comprises a ceramic.

4. The jetting tool of claim 3, wherein the ceramic comprises a carbide.

5. The jetting tool of claim 4, wherein the carbide comprises a carbide without a binder.

6. The jetting tool of claim 4, wherein the carbide comprises a carbide with a binder.

7. The jetting tool of claim 6, wherein the binder is one of cobalt or molybdenum.

8. The jetting tool of claim 1, wherein the jetting tool is a hydrajetting tool.

9. The jetting tool of claim 1, wherein the material has a hardness greater than 80 Rockwell A.

10. The jetting tool of claim 1, wherein the jetting tool is a fracturing tool.

11. The jetting tool of claim 1 wherein at least one of the holders comprises one of steel or fiberglass.

12. The jetting tool of claim 1 wherein the holders are separable from the sleeve.

13. A fluid jetting device comprising:

a cylindrical body for bearing and delivering a high-pressure fluid, wherein the cylindrical body forms a cylindrical body wall having a first orifice extending radially therethrough, wherein the cylindrical body has a hardness greater than 75 Rockwell A;

a first holder that is substantially cylindrical and that longitudinally interfaces a first end of the cylindrical body;

a second holder that is substantially cylindrical, wherein the second holder comprises a first part that longitudinally interfaces a second end of the cylindrical body and a second part;

an orifice extending radially through one of the holders;

wherein the first orifice and the orifice of the holders may be substantially aligned;

wherein a fluid flowing through the cylindrical body exits through the first orifice and the orifice of the holders; and wherein each of the first holder, the second holder, and the cylindrical body comprise an inner substantially cylindrical surface that is radially disposed about a common axis and that is configured to directly bear high-pressure fluid.

14. The jetting device of claim 13, wherein the cylindrical body comprises a ceramic.

15. The jetting device of claim 14, wherein the ceramic comprises a carbide.

16. The jetting device of claim 13, wherein the cylindrical body comprises a plurality of substantially cylindrical body parts that interface at least longitudinally to form the cylindrical body wall, wherein:

the first orifice extends radially through one of the cylindrical body parts;

a first substantially cylindrical body part comprises the first end of the cylindrical body; and a second substantially cylindrical body part comprises the second end of the cylindrical body.

17. The jetting device of claim 13, wherein the second part of the second holder comprises a second inner substantially cylindrical surface configured to extend around an outermost radial surface of the cylindrical body wall so that the second inner substantially cylindrical surface does not directly bear high-pressure fluid.

18. The jetting device of claim 13 wherein at least one of the holders comprises one of steel or fiberglass.

19. The jetting device of claim 13 wherein the holders are separable from the cylindrical body.

* * * * *